US009520631B2

(12) United States Patent
Pierides

(10) Patent No.: US 9,520,631 B2
(45) Date of Patent: Dec. 13, 2016

(54) SPHERICAL FILTER

(71) Applicant: FutureWei Technologies, Inc., Plano, TX (US)

(72) Inventor: Alexis Pierides, Piscataway, NJ (US)

(73) Assignee: FUTURWEI TECHNOLOGIES, INC., Plano, TX (US)

( * ) Notice: Subject to any disclaimer, the term of this patent is extended or adjusted under 35 U.S.C. 154(b) by 429 days.

(21) Appl. No.: 13/654,215

(22) Filed: Oct. 17, 2012

(65) Prior Publication Data

US 2014/0104015 A1 Apr. 17, 2014

(51) Int. Cl.

| | |
|---|---|
| ***H01P 1/202*** | (2006.01) |
| ***H01P 7/04*** | (2006.01) |
| ***H01P 1/205*** | (2006.01) |
| *H01P 1/20* | (2006.01) |

(52) U.S. Cl.

CPC ..... *H01P 1/202* (2013.01); *H01P 1/205* (2013.01); *H01P 1/2053* (2013.01); *H01P 7/04* (2013.01); *H01P 1/20* (2013.01)

(58) Field of Classification Search

CPC ..... H01P 1/202; H01P 1/205; H01P 1/2053; H01P 7/04; H01P 7/00; H01P 1/20

USPC ..... 333/202, 207, 223, 224, 235

See application file for complete search history.

(56) References Cited

U.S. PATENT DOCUMENTS

| | | | | |
|---|---|---|---|---|
| 5,986,526 | A * | 11/1999 | Kopal et al. | 333/232 |
| 6,407,651 | B1 * | 6/2002 | Wulff et al. | 333/224 |
| 7,449,981 | B2 * | 11/2008 | Park et al. | 333/203 |
| 8,618,894 | B2 * | 12/2013 | Kim et al. | 333/202 |
| 2009/0316364 | A1 * | 12/2009 | Yamada et al. | 361/709 |
| 2011/0030197 | A1 | 2/2011 | Lagrotta et al. | |
| 2011/0316650 | A1 * | 12/2011 | Park et al. | 333/203 |

* cited by examiner

*Primary Examiner* — Benny Lee
*Assistant Examiner* — Jorge Salazar, Jr.
(74) *Attorney, Agent, or Firm* — Futurewei Technologies Inc.

(57) ABSTRACT

An embodiment filter including metallic plating unitarily forming a spherical shell and a resonator, the resonator defining a resonator cavity, a tuning nut disposed in a lower portion of the resonator cavity, and a tuning screw threadably secured within the resonator cavity by the tuning nut, the tuning screw rotatable to deform an upper portion of the resonator to tune the filter.

10 Claims, 7 Drawing Sheets

SPHERICAL FILTER

TECHNICAL FIELD

The present disclosure relates to a filter and, in particular, to a radio frequency (RF) filter used to filter signals received by or transmitted from an antenna during wireless communications.

BACKGROUND

The radio frequency filter electrically coupled to the antenna is an important part of wireless communications. Indeed, the filter is typically the first component that a signal encounters after being received by the antenna. In addition, the filter is typically the last component the signal encounters before being transmitted by the antenna.

As the components, geometry, and architecture of radio frequency assemblies and systems have improved and miniaturized over time, the filter, whose size is bound to frequency, is now one of the heaviest components. Moreover, the filter is often formed through brute machining and calls for extreme accuracy. Therefore, the filter may also be one of the most expensive components in radio frequency assemblies and systems to fabricate.

Because the filter needs to be die-casted, individually precision machined, plated, and manually assembled there is no particularly desirable or suitable mass manufacturing method for forming the filter.

SUMMARY

An embodiment filter includes metallic plating unitarily forming a spherical shell and a resonator, the resonator defining a resonator cavity, a tuning nut disposed in the resonator cavity, and a tuning screw threadably secured within the resonator cavity by the tuning nut, the tuning screw rotatable to deform an upper portion of the resonator to tune the filter.

An embodiment filter metallic includes metallic plating unitarily forming a shell and a resonator structure opposing a resonator, the resonator defining a resonator cavity, a tuning nut disposed in the resonator cavity, and a tuning screw threadably secured within the resonator cavity by the tuning nut, the tuning screw rotatable to deform an upper portion of the resonator to tune the filter.

An embodiment filter includes a resonator having a cavity extending through an arcuate upper portion thereof, metallic plating forming a spherical shell around the resonator, a tuning nut mounted on the spherical shell proximate to the cavity in the resonator, and a tuning screw threadably secured within the cavity by the tuning nut, the tuning screw rotatable to change a capacitance between the resonator and the spherical shell to tune the filter.

BRIEF DESCRIPTION OF THE DRAWINGS

For a more complete understanding of the present disclosure, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

The present disclosure will be described with respect to preferred embodiments in a specific context, namely a radio frequency (RF) filter for use in wireless communications. The concepts in the disclosure may also apply, however, to other types of filters or communications.

Figure 1:
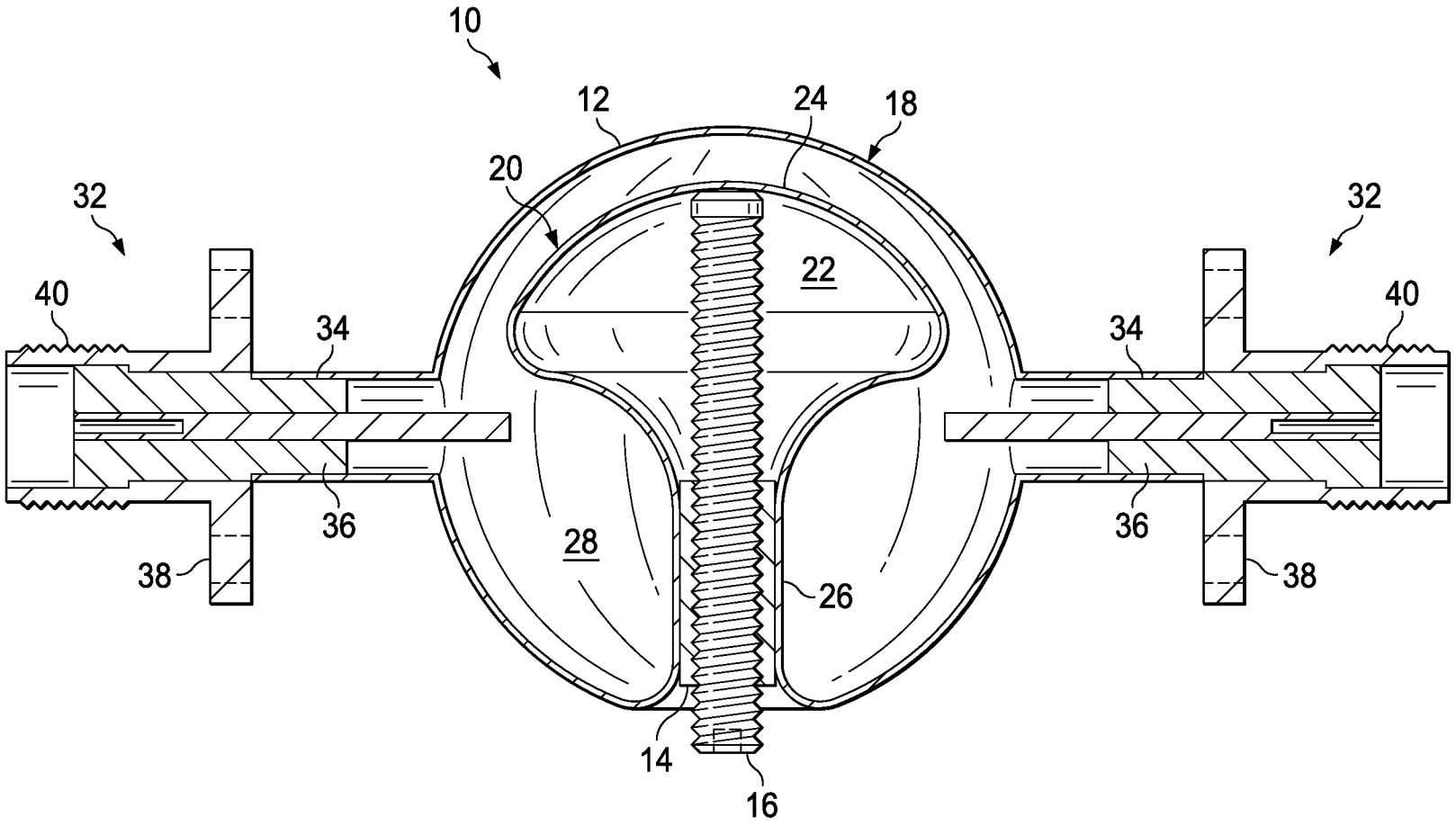
FIG. 1 illustrates in cross section an embodiment filter with a generally spherical shell surrounding a resonator.

Referring now to FIG. 1, an embodiment filter 10 is illustrated. The filter 10 includes metallic plating 12, a tuning nut 14, and a tuning screw 16. In an embodiment, the metallic plating 12 is formed from copper, nickel, or a combination of those metals. In an embodiment, the metallic plating 12 is formed from a layer of copper or other radio frequency conductive material beneath a layer of nickel or other metal providing structural integrity to the filter 10. In an embodiment, the copper layer is between about 0.003 inches to about 0.005 inches and the nickel layer is about 0.015 inches. In other embodiments, other suitable metals with other thicknesses may be employed to form the metal plating 12 of FIG. 1.

Still referring to FIG. 1, the metallic plating 12 is employed to form a generally spherical shell 18 and a resonator 20. In an embodiment, the spherical shell 18 and the resonator 20 are unitarily formed. In other words, the spherical shell 18 and the resonator 20 are integrally formed with each other to produce a single or solitary structure using the metallic plating 12.

The resonator 20 defines a resonator cavity 22 and has an upper portion 24 and a lower portion 26. In an embodiment, a curvature of the upper portion 24 of the resonator 20 matches a curvature of the spherical shell 18 proximate to the upper portion 24 of the resonator 20. In other words, as shown in FIG. 1, the profile of the upper portion 24 of the resonator 20 generally corresponds to the profile of the spherical shell 18 just above it. In an embodiment, the resonator cavity 26 generally forms a dome over the tuning screw 16.

As shown in FIG. 1, in an embodiment a width of the upper portion 24 of the resonator 20 is greater than a width of a lower portion 26 of the resonator 20. In an embodiment the lower portion 26 of the resonator 20 is generally cylindrical. The resonator 20 receives and supports the tuning nut 14. In particular, the tuning nut 14 is mounted within a lower portion of the resonator cavity 26. In this configuration, the tuning nut 14 is able to threadably secure the tuning screw 16 within the resonator cavity 26.

Figure 2:
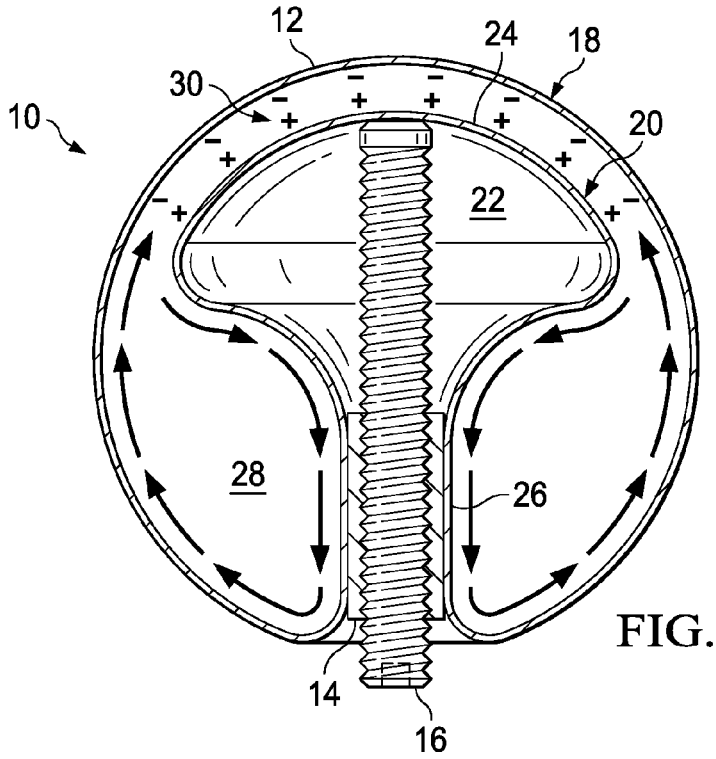
FIG. 2 illustrates a capacitance in the filter of FIG. 1.

As shown in FIG. 1, the tuning screw 16 does not extend or project into an internal filter cavity 28. Rather, the tuning screw 16 is retained within or relegated to the resonator cavity 22. The tuning screw 16 is rotatable relative to the tuning nut 14. As such, the tuning screw 16 may be driven into the upper portion 24 of the resonator 20. As the tuning screw 16 continues to rotate, the upper portion 24 of the resonator 20 is elastically or plastically deformed, which reduces a distance between the upper portion 24 of the resonator 20 and the spherical shell 18 above it. By altering the distance between the upper portion 24 of the resonator 20 and the spherical shell 18, a capacitance 30 as shown in FIG. 2 may be changed. By changing the capacitance 30, the filter 10 may be suitably tuned.

Referring to FIGS. 1-2, the resonator cavity 22 is isolated from the filter cavity 28 by the metallic plating 12 of the resonator 20. In an embodiment, the filter cavity 28 is hollow. In other words, any solid or semi-solid materials or substances used to retain the shape of the metallic plating 12 and/or form the spherical shell 18 and the resonator 20 have been removed from within the filter cavity 28. In an embodiment, the filter cavity 28 is hermetically sealed.

As shown in FIG. 1, in an embodiment the filter 10 includes one or more signal input/output ports 32. In an embodiment, the ports 32 are partially formed using the metal plating 12. In other words, the ports 12 may be at least partially unitarily formed with the spherical shell 18. The ports 32 may include signal relaying components 34 within plugs 36, mounting brackets 38, external threads 40, and so on.

Figure 3:
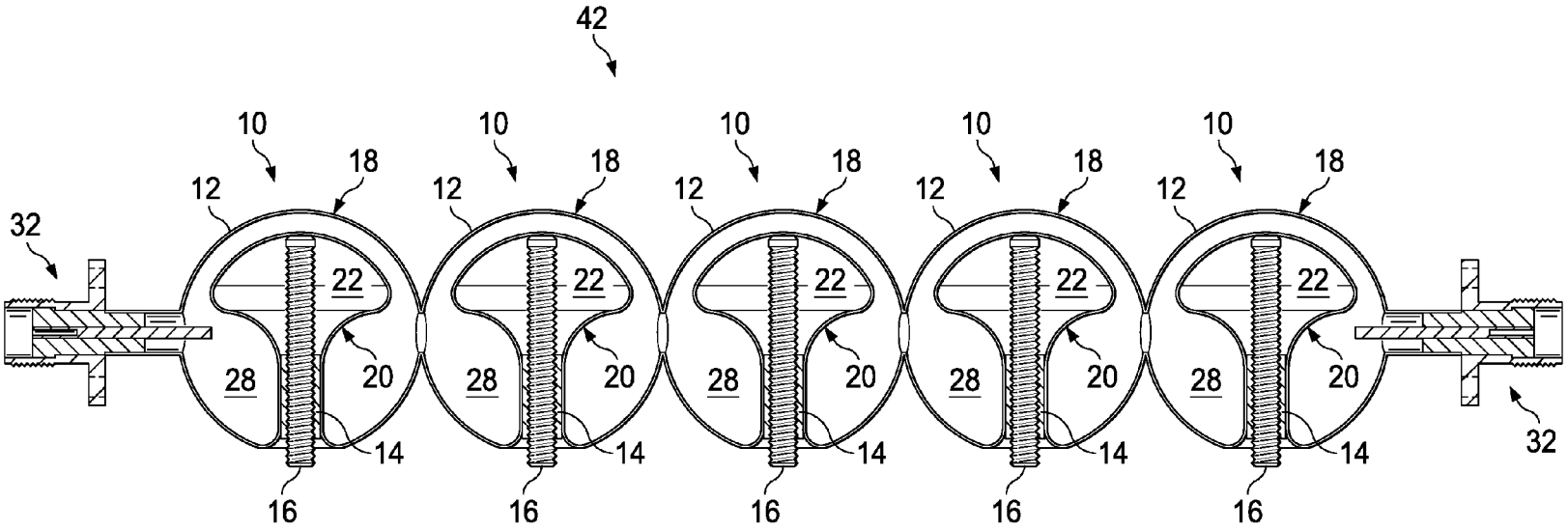
FIG. 3 illustrates a filter bank formed from a plurality of the filters of FIG. 1.

Referring now to FIG. 3, a plurality of the filters 10 may be operably coupled together to provide a filter bank 42. In such a configuration, the spherical shells 12 of neighboring filters 10 may be merged together. In addition, a single pair of the input/output ports 32 may be employed to service the filter bank 42. Despite five of the filters 10 being included in the filter bank 42 in FIG. 3, more of fewer of the filters 10 may be included in the filter bank 42 in other embodiments.

Figure 4:
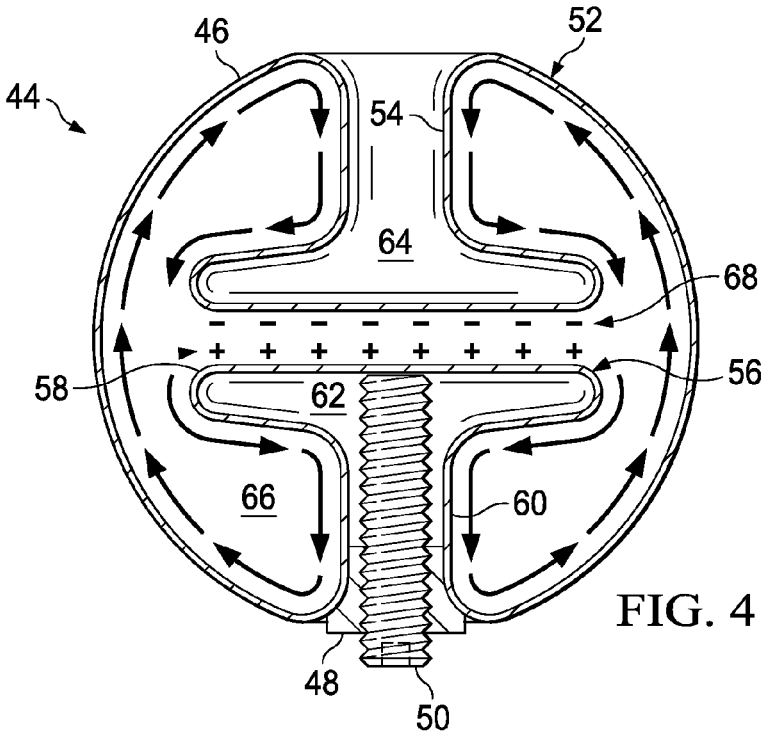
FIG. 4 illustrates in cross section an embodiment filter with a resonator structure opposing a resonator and a generally spherical shell.

Referring now to FIG. 4, an embodiment filter 44 is illustrated. In some embodiments, the filter 44 of FIG. 4 may share certain features and characteristics (e.g., the material used for the metal plating) with the filter 10 of FIG. 1. For the sake of brevity, a detailed explanation of such features and characteristics is omitted.

As shown in FIG. 4, the filter 44 also includes metallic plating 46, a tuning nut 48, and a tuning screw 50. The metallic plating 46 unitarily forms a shell 52 and an inverted resonator structure 54 opposing a resonator 56. In an embodiment, each of the shell 52, the resonator structure 54, and the resonator 56 are unitarily formed. In other words, the shell 52, the resonator structure 54, and the resonator 56 are integrally formed with each other to produce a solitary structure using the metallic plating 46. In an embodiment, the shell 52 has a generally spherical shape.

The resonator 56 of FIG. 4 generally includes an upper portion 58 and a lower portion 60. The resonator 56 also defines a resonator cavity 62, which is mirrored by an open cavity 64 defined by the opposing inverted resonator structure 54. In an embodiment, the resonator structure 54 and the resonator 56 have a matching profile shape as shown in FIG. 4. In an embodiment, a "ceiling" of the resonator 56 and a "floor" of the inverted resonator structure 54 are planar and parallel. As such, the flexibility and/or elasticity of the resonator 56 may be enhanced relative to, for example, the filter 10 in FIG. 1.

As shown in FIG. 4, the lower portion of the resonator cavity 62 generally receives and supports the tuning nut 48. In other words, the tuning nut 48 is mounted within the lower portion of the resonator cavity 62. In this configuration, the tuning nut 48 is able to threadably secure the tuning screw 50 within the resonator cavity 62.

As shown in FIG. 4, the tuning screw 50 does not extend or project into a filter cavity 66. Rather, the tuning screw 50 is retained within the resonator cavity 62. The tuning screw 50 is rotatable relative to the tuning nut 48. As such, the tuning screw 50 may be driven into the upper portion 58 of the resonator 56. As the tuning screw 50 continues to rotate, the upper portion 58 of the resonator 56 is elastically or plastically deformed, which reduces a distance between the upper portion 58 of the resonator 56 and the floor of the inverted resonator structure 54. By altering the distance between the upper portion 58 of the resonator 56 and the floor of the resonator structure 54, a capacitance 68 may be changed, which permits the filter 44 to be suitably tuned.

Referring to FIG. 4, the resonator cavity 62 is isolated from the filter cavity 66 by the resonator 56. In an embodiment, the filter cavity 66 is hollow. In other words, any solid or semi-solid materials or substances used to retain the shape of the metallic plating 46 and/or form the spherical shell 52 and the resonator 56 have been removed from within the filter cavity 66. In an embodiment, the filter cavity 66 is hermetically sealed.

Figure 5:
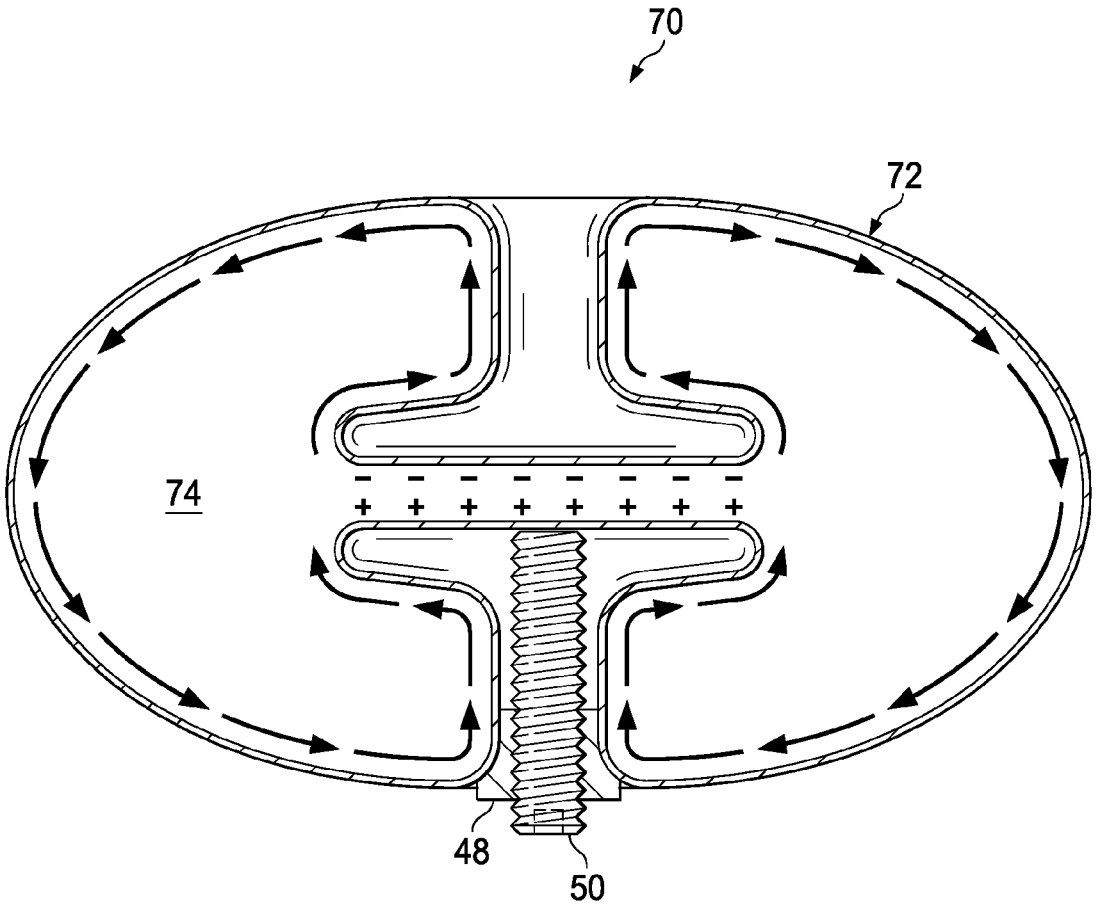
FIG. 5 illustrates in cross section an embodiment filter with a resonator structure opposing a resonator and a generally oval shell.

Referring now to FIG. 5, an embodiment filter 70 has an oval shaped shell 72. In other words, the filter 70 of FIG. 5 has been flattened relative to, for example, the filter 44 of FIG. 4. By flattening the filter 70 of FIG. 5, the volume of a filter cavity 74 is reduced. This allows for a smaller overall filter 70 relative to, for example, the filter 44 depicted in FIG. 4. The reduced size of the filter 70 may be beneficial where, for example, the overall size of the device is a design consideration.

Figure 6:
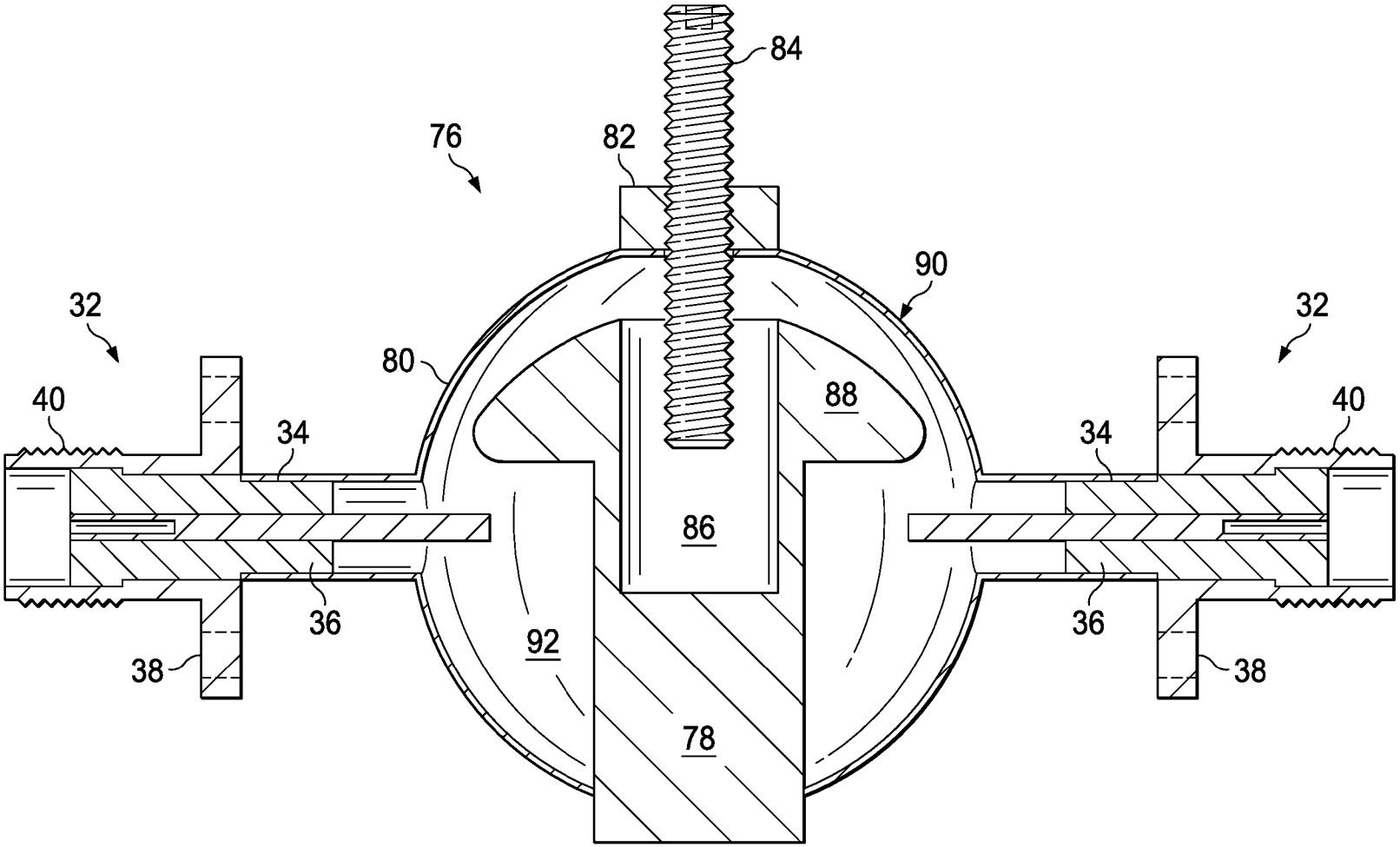
FIG. 6 illustrates in cross section an embodiment filter with a generally spherical shell surrounding a solid resonator.
Figure 7:
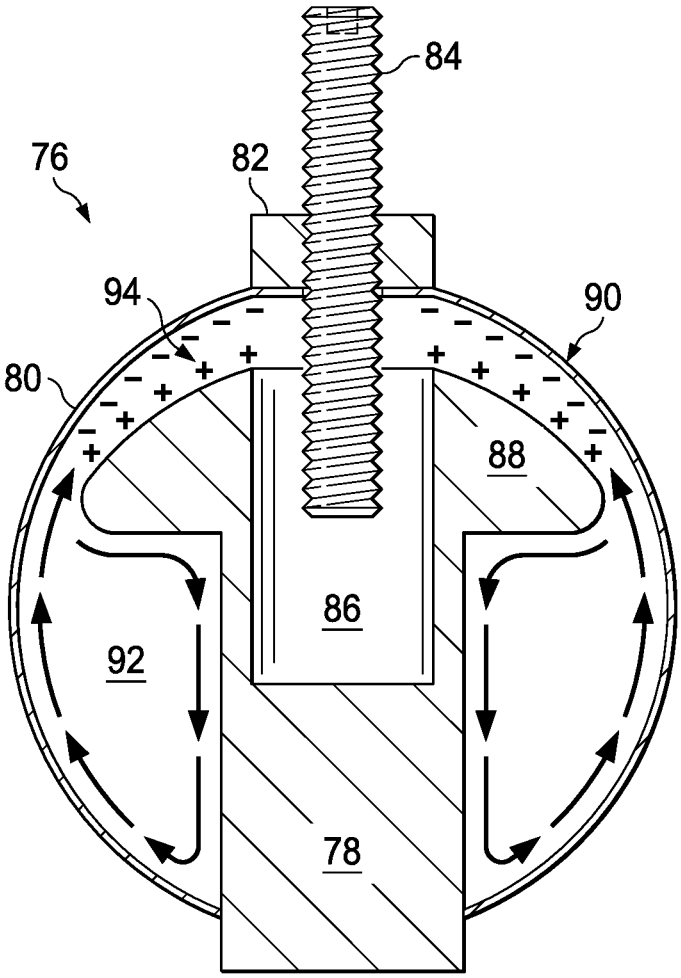
FIG. 7 illustrates a capacitance in the filter of FIG. 6.

Referring now to FIGS. 6-7, an embodiment filter 76 is illustrated. The filter 76 includes a resonator 78, metallic plating 80, a tuning nut 82, and a tuning screw 84. The resonator 78 generally has a cavity 86 extending through an arcuate upper portion 88 of the resonator 78. In an embodiment, the resonator 78 is formed from a solid metal. In other words, unlike the resonators 20, 56 shown in FIGS. 1-5, the resonator 78 of FIGS. 6-7 is not hollow.

The metallic plating 80 of the filter 76 forms a generally spherical shell 90 around the resonator 78. In an embodiment, a curvature of the arcuate upper portion 88 of the resonator 78 matches a curvature of the spherical shell 90 proximate to the upper portion 88 of the resonator 78. In other words, the opposing surfaces are generally parallel with one another. In an embodiment, the spherical shell 90 and an external surface of the resonator 78 collectively define a filter cavity 92. The filter cavity 92 is configured to receive a portion of the tuning screw 84.

As shown in FIGS. 6-7, in an embodiment the tuning nut 82 is mounted on the spherical shell 90 relative to the cavity 86 in the resonator 78. The tuning screw 84 is threadably secured within the cavity 86 by the tuning nut 82. The tuning screw 84 is rotatable to drive the tuning screw further into the cavity 86 or to retract the tuning screw 84 from the cavity 86, which alters a capacitance 94. By altering the capacitance 94, the filter 76 may be suitably tuned.

Figure 8:
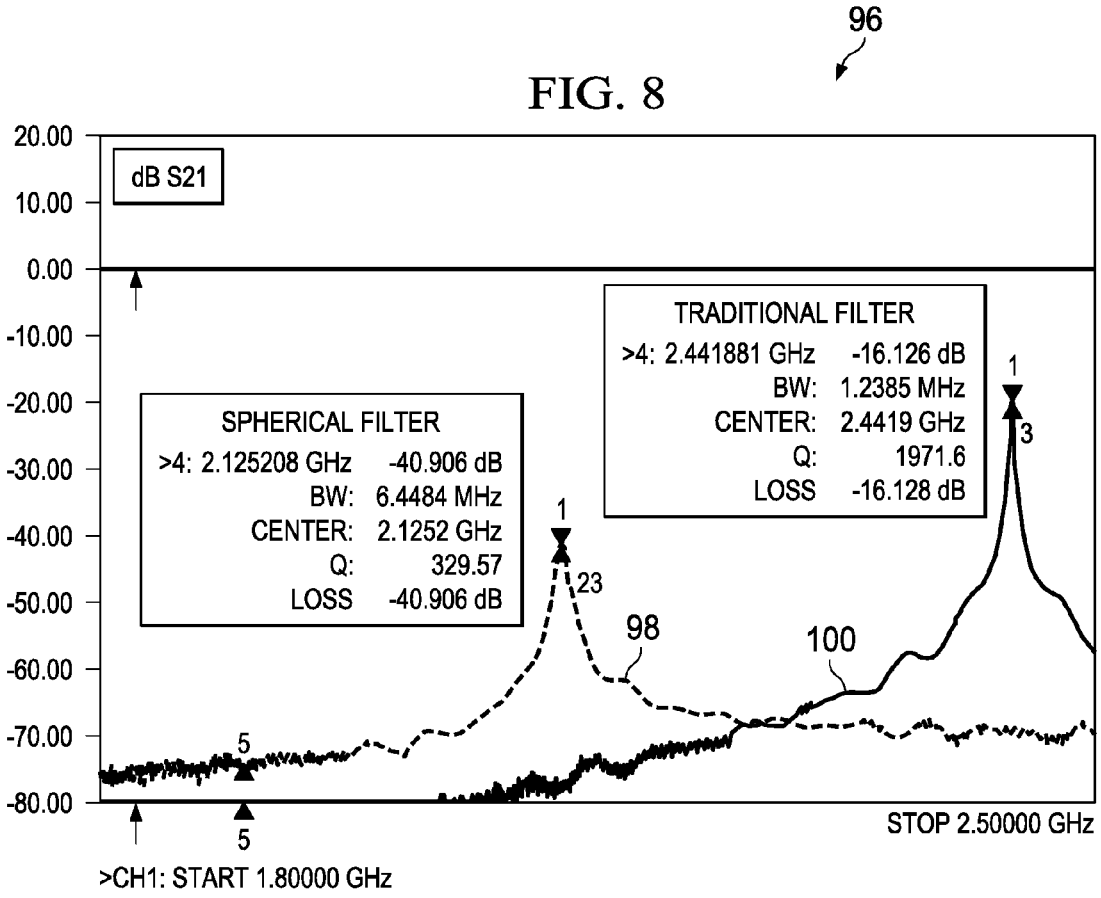
FIG. 8 is a graphical representation of a comparison of a traditional cubic filter response to a spherical cavity filter response.

Referring now to FIG. 8, a graphical representation 96 offers a comparison of a traditional cubic filter response to a spherical cavity filter response. In particular, the output signal 98 for a spherical cavity filter relative to the output signal 100 for a conventional cubic filter when excited with a wide frequency range signal is shown.

From the foregoing, it should be recognized that the spherical or rounded shape of the filters disclosed herein provides a desirable structural integrity to the filters. This spherical or rounded shape may also make fabrication of the filters easier and more precise. Moreover, tuning of some of the filters can be achieved without having the tuning screw penetrate the internal filter cavity in many cases.

Because the filters are hermetically sealed due to, in part, the unitary nature of the metallic plating additional weatherization steps may not be needed. In addition, the part count of the filters is reduced relative to conventional cube filters. Moreover, because the resonators and the internal filter cavities are hollow in many of the filters, the filter is relatively light weight. Also, because the rounded filters are free of corners like conventional cube filters, energy losses are reduced.

While the disclosure provides illustrative embodiments, this description is not intended to be construed in a limiting sense. Various modifications and combinations of the illustrative embodiments, as well as other embodiments, will be apparent to persons skilled in the art upon reference to the description. It is therefore intended that the appended claims encompass any such modifications or embodiments.

What is claimed is:

1. A filter, comprising:

a spherical shell;

a resonator, wherein the resonator defines a resonator cavity, and the spherical shell and the resonator are integrally formed with each other to produce a single structure comprising a single metallic plate;

a tuning nut disposed within the resonator cavity; and a tuning screw threadably secured within the resonator cavity by the tuning nut, the tuning screw rotatable to deform an upper portion of the single metallic plate to tune the filter by changing distance between the upper portion of the single metallic plate and the spherical shell.

2. The filter of claim 1, wherein a curvature of the upper portion of the single metallic plate matches an opposing curvature of the spherical shell proximate to the upper portion of the single metallic plate.

3. The filter of claim 1, wherein the single metallic plate of the resonator isolates the resonator cavity from a hollow filter cavity located between the resonator and the spherical shell.

4. The filter of claim 3, wherein the hollow filter cavity is free of the tuning screw.

5. The filter of claim 4, wherein the hollow filter cavity surrounds the resonator.

6. The filter of claim 4, wherein the hollow filter cavity is hermetically sealed.

7. The filter of claim 1, wherein the single metallic plate comprises at least one of copper, nickel, and a combination of copper and nickel.

8. The filter of claim 1, wherein at least one signal input/output port is integrally formed with the spherical shell.

9. A filter, comprising:

a resonator having a cavity extending through an arcuate upper portion of the resonator;

a spherical shell formed around the resonator; the spherical shell and the resonator are integrally formed with each other to produce a single structure comprising a single metallic plate;

a tuning nut mounted on the spherical shell proximate to the cavity in the resonator; and a tuning screw threadably secured within the cavity by the tuning nut and the tuning screw being in contact with an upper portion of the single metallic plate, the tuning screw rotatable to change a capacitance between the single metallic plate and the spherical shell to tune the filter by changing distance between the upper portion of the single metallic plate and the spherical shell.

10. The filter of claim 9, wherein a curvature of the arcuate upper portion of the resonator matches a corresponding curvature of the spherical shell proximate to the upper portion of the single metallic plate.

* * * * *